US007442130B2

(12) United States Patent
Ban et al.

(10) Patent No.: US 7,442,130 B2
(45) Date of Patent: Oct. 28, 2008

(54) IRON SET

(75) Inventors: Wataru Ban, Chichibu (JP); Koki Motoyoshi, Minamiooi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/645,741

(22) Filed: Dec. 27, 2006

(65) Prior Publication Data

US 2007/0149305 A1 Jun. 28, 2007

(30) Foreign Application Priority Data

Dec. 27, 2005 (JP) ..... 2005-374191

(51) Int. Cl.
*A63B 53/00* (2006.01)

(52) U.S. Cl. ..... 473/290; 473/328

(58) Field of Classification Search ..... 473/290–291, 473/328
See application file for complete search history.

(56) References Cited

U.S. PATENT DOCUMENTS

| | | | | |
|---|---|---|---|---|
| 4,854,580 | A * | 8/1989 | Kobayashi | 473/290 |
| 5,549,296 | A * | 8/1996 | Gilbert | 473/290 |
| 5,800,281 | A * | 9/1998 | Gilbert | 473/287 |
| 5,971,866 | A * | 10/1999 | Adams et al. | 473/328 |
| 6,471,601 | B1 * | 10/2002 | McCabe et al. | 473/290 |
| 6,645,085 | B2 * | 11/2003 | McCabe et al. | 473/290 |

FOREIGN PATENT DOCUMENTS

JP 8-257179 A 10/1996

* cited by examiner

*Primary Examiner*—Stephen L. Blau
(74) *Attorney, Agent, or Firm*—Sughrue Mion, PLLC

(57) ABSTRACT

An iron set has plural iron golf clubs, in which loft angles of heads are larger as the number is increased, each golf club including the head having a sole that includes a front sole on a front side and a rear sole adjacent to the front sole. A bounce angle $\theta_2$ of the rear sole is smaller than a bounce angle $\theta_1$ of the front sole, and a width $L_2$ of the rear sole in a front-rear direction is greater than or equal to a width $L_1$ of the front sole in the front-rear direction. The width $L_1$ is from 5 to 12 mm in any of the golf clubs, the bounce angle of the front sole for the number n club is greater than or equal to the bounce angle of the front sole for the number (n-1) club and greater than the bounce angle of the front sole for the number (n-2) club.

9 Claims, 6 Drawing Sheets

IRON SET

BACKGROUND OF THE INVENTION

1. Field of the Invention

The present invention relates to an iron set composed of a plurality of irons (iron golf clubs) of different numbers, and more particularly to an iron set, in which a sole of each iron has a front sole with a relatively large bounce angle and a rear sole with a relatively small bounce angle and a width of the rear sole in a front-rear direction is greater than or equal to a width of the front sole in the front-rear direction.

2. Description of the Related Art

JP-A-8-257179 discloses an iron set, in which a sole of each iron has a front sole with a relatively large bounce angle and a rear sole with a relatively small bounce angle, and a width of the rear sole in the front rear direction is greater than or equal to a width of the front sole in the front-rear direction. In FIG. 3 and Table 1 of this publication, it is described that the number 1 to 3 irons have a bounce angle of 20° on the front sole and a width of 3.1 mm (0.123 inches), the number 4 to 7 irons have a bounce angle of 25° on the front sole and a width of 3.9 mm (0.154 inches), and the number 8 and 9 irons have a bounce angle of 30° on the front sole and a width of 3.9 mm, and the number 1 to 8 irons have a width of 12.4 mm (0.487 inches) on the rear sole.

SUMMARY OF THE INVENTION

The iron disclosed in JP-A-8-257179 is designed so as not to dig the ground in hitting the ball.

An object of the present invention is to provide an iron set in which any of irons ranging from a small number iron to a large number iron has less resistance received from the lawn surface in the golf course and can be swung smoothly, and is more adaptable to every person who has any swing type and head speed.

According to a first aspect of the invention, there is provided an iron set comprising: a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole smaller than a bounce angle $\theta_1$ of the front sole, and a width $L_2$ of the rear sole in a front-rear direction is greater than or equal to a width $L_1$ of the front sole in the front-rear direction, and the width $L_1$ is from 5 to 12 mm in any of the golf clubs, the bounce angle of the front sole for the number n club is greater than or equal to the bounce angle of the front sole for the number (n-1) club and greater than the bounce angle of the front sole for the number (n-2) club.

According to a second aspect of the invention, the bounce angle of the rear sole for the number n club is greater than or equal to the bounce angle of the rear sole for the number (n-1) club and greater than the bounce angle of the rear sole for the number (n-2) club.

According to a third aspect of the invention, the bounce angle of the front sole for the number six iron is from 6 to 9°, and the bounce angle of the rear sole is from 2 to 5°.

In the iron set, the bounce angle of the front sole is almost constantly increased as the number is increased. That is, the clubs differing by one club number have the same bounce angle or the club with larger number has a larger bounce angle of the front sole. Also, of the clubs differing by two club number, the club with larger number necessarily has the larger bounce angle of the front sole. In this way, the bounce angle of the front sole is set to be necessarily larger for the club with larger number, whereby the same swing feeling (swing sense) can be acquired for each number.

For not only the front sole but also the rear sole, the club with larger number has an almost larger bounce angle. That is, the clubs differing by one club number may have the same bounce angle of the rear sole, but of the clubs differing by two club number, the club with larger number necessarily has the larger bounce angle, whereby the swing sense is similar for each number.

DETAILED DESCRIPTION OF THE PREFERRED EMBODIMENTS

Figure 1:
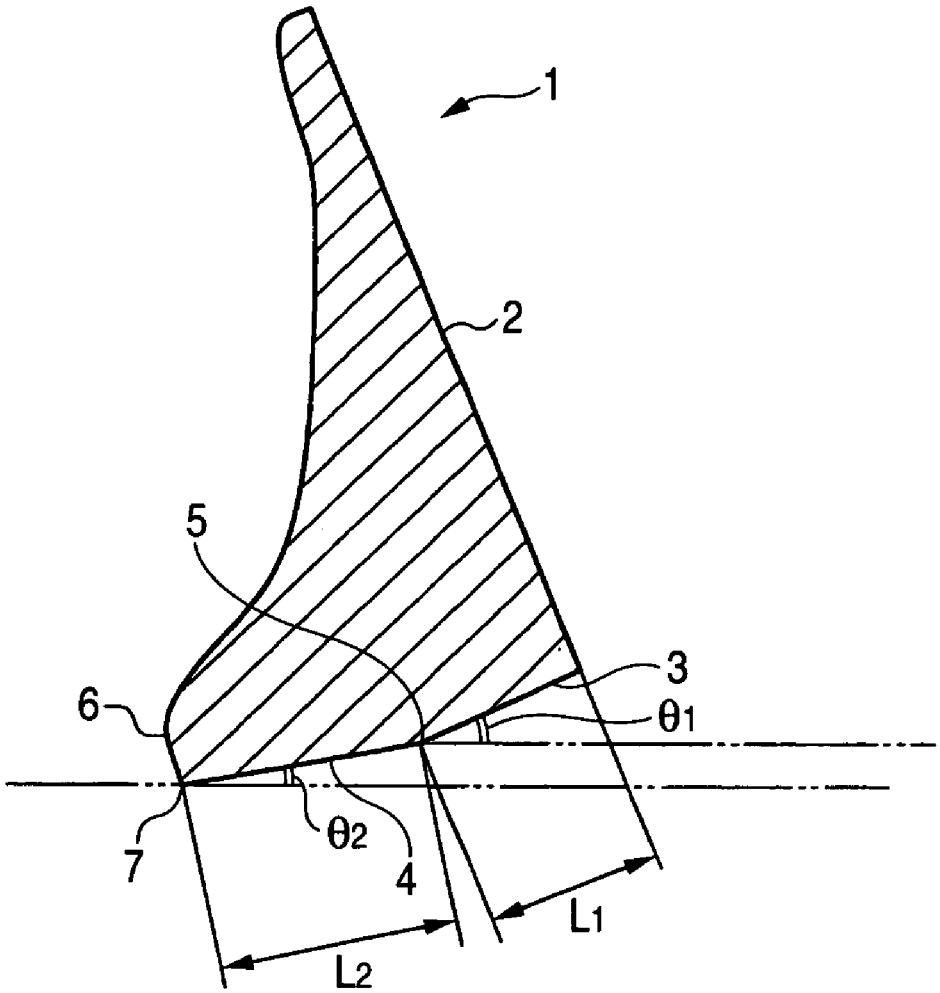
FIG. 1 is a cross-sectional view of a head according to an embodiment of the present invention.

Embodiments of the present invention will be described below with reference to the drawings. FIG. 1 is a longitudinal cross-sectional view, taken along a direction orthogonal to a face, showing one example of an iron head for an iron set according to an embodiment of the invention. A front face of this head 1 is a face 2 for hitting the ball. The face 2 is provided with a plurality of parallel grooves (score lines) extending in a toe-heel direction of the head. The length of each score line is identical, and each score line is aligned at both ends. The center of the score line in a longitudinal direction is the center of the face in the toe-heel direction.

FIG. 1 is a longitudinal cross-sectional view taken through the center in the toe-heel direction. The bounce angle and the width of a front sole and a rear sole refer to the bounce angle and the width on the longitudinal cross-section passing through the center in the toe-heel direction. The bounce angle is measured in a state where the club is normally soled on the horizontal plane. Normally soled means a state where the score line is horizontal, and when the vertical plane parallel to that including the score line and passing though a hosel is supposed, a club shaft is included within this vertical plane.

The sole of the head 1 comprises a front sole 3 on the face side, and a rear sole 4 on the back side adjacent to the front sole 3.

The bounce angle $\theta_1$ and the width $L_1$ of the front sole 3 and the bounce angle $\theta_2$ and the width $L_2$ of the rear sole are shown in the figure.

In FIG. 1, the front sole 3 and the rear sole 4 are planar, and an intersection portion between both forms a peaked, convex portion 5, but this convex portion 5 may be roundish. In the later case, supposing that the point at which the imaginary planes extending from the front sole 3 and the rear sole 4 intersect is the intersection portion of the front sole 3 and the rear sole 4, the widths $L_1$ and $L_2$ are measured.

$L_1$ is the distance from the convex portion 5 or the intersection portion to the face 2.

A leading edge that is the intersection portion between the front sole 3 and the face may be roundish or obliquely faceted, in which the width of the front sole 3 is measured as the distance from the convex portion 5 or the intersection portion to the face 2.

In FIG. 1, a rear edge 7 where the rear sole 4 and a head rear face 6 are crossed also forms a convex portion. $L_2$ is measured as the distance from the rear edge to the convex portion 5 or the intersection portion. However, the rear edge 7 may be roundish or obliquely faceted. In this case, $L_2$ is the distance from the imaginary plane parallel to the face and passing through the trailing edge of the head to the convex portion 5 or the intersection portion.

The iron set may include the number 3 to number 10 irons (pitching wedge), the number 4 or 5 to number 10 irons, or the number 6 to number 10 irons. Of course, the iron set may include the number 11 iron (usually called a pitching or approach wedge) or a sand wedge (number 12 iron in this embodiment), and a lob wedge (number 13 iron). Also, the iron set may include the number 2 iron or number 1 iron.

The bounce angle $\theta_1$ of the front sole for the number n iron is greater than or equal to the bounce angle $\theta_1$ of the front sole for the number (n-1) club, and greater than the bounce angle $\theta_1$ of the front sole for the number (n-2) club. Preferably, the bounce angle $\theta_2$ of the rear sole for the number n iron is greater than or equal to the bounce angle $\theta_2$ of the rear sole for the number (n-1) club, and greater than the bounce angle $\theta_2$ of the rear sole for the number (n-2) club.

For the number 3 iron, it is preferred that $\theta_1$ is from 5 to 8°, and $\theta_2$ is from 2 to 4°. For the number 6 iron, it is preferred that $\theta_1$ is from 6 to 9°, and $\theta_2$ is from 2 to 5°. For the number 9 iron, it is preferred that $\theta_1$ is from 8 to 10°, and $\theta_2$ is from 4 to 7°. In any of the clubs, it is preferred that $(\theta_1-\theta_2)$ is from 2 to 7°, particularly from 3 to 6°.

The width $L_2$ of the rear sole is greater than the width $L_1$ of the front sole in any of the clubs. Preferably, $L_2$ is one to twice $L_1$, particularly one to 1.5 times. In any of the clubs, $L_1$ is from 5 to 12 mm. In the case of the number 3 iron, it is preferred that $L_1$ is from 5 to 9 mm, particularly from 6 to 8 mm. In the case of the number 6 iron, it is preferred that $L_1$ is from 6 to 10 mm, particularly from 7 to 9 mm. In the case of the number 9 iron, it is preferred that $L_1$ is from 8 to 12 mm, particularly from 9 to 11 mm.

Preferably, $L_1$ of the number n iron is greater than or equal to $L_1$ of the number (n-1) iron, and greater than $L_1$ of the number (n-2) iron. Also, preferably, $L_2$ of the number n iron is greater than or equal to $L_2$ of the number (n-1) iron, and greater than $L_2$ of the number (n-2) iron.

Preferable examples of $L_1$, $\theta_1$, $L_2$ and $\theta_2$ are shown in Table 1 below.

TABLE 1

| Number | $L_1$ (mm) | $\theta_1$ (°) | $L_2$ (mm) | $\theta_2$ (°) |
|---|---|---|---|---|
| 3 | 7 | 5 | 8 | 2 |
| 4 | 7 | 6 | 9 | 2 |
| 5 | 8 | 6 | 9 | 3 |
| 6 | 8 | 7 | 9 | 3 |
| 7 | 9 | 7 | 10 | 4 |
| 8 | 9 | 8 | 10 | 4 |
| 9 | 10 | 9 | 10 | 5 |
| 10 (P) | 10 | 10 | 11 | 5 |

(P is pitching)

The material of the iron is preferably iron such as steel, soft iron or pure iron, or iron alloy, but may be a dissimilar material such as titanium alloy or copper alloy for the face.

Examples

Examples 1, 2 and comparative examples 1 to 8

The values of $L_1$, $L_2$, $\theta_1$ and $\theta_2$ for the number 3, 6 and 9 irons are shown in Table 2. An iron club was produced by making the iron head of soft iron, and attaching a carbon shaft. The length of shaft was 38.5 inches (about 97.8 cm) for the number 3 iron, 37 inches (about 94 cm) for the number 6 iron, and 35.5 inches (about 90.2 cm) for the number 9 iron.

In order to find the sole shape conformable to any person of various swing types, four subjects who were different in the head speed and the swing trajectory were selected.

The subject A is the person of the type in which the swing trajectory at impact is acute angle and the head speed is fast.

The subject B is the person of the type in which the swing trajectory at impact is obtuse angle and the head speed is fast.

The subject C is the person of the type in which the swing trajectory at impact is acute angle and the head speed is slow.

The subject D is the person of the type in which the swing trajectory at impact is obtuse angle and the head speed is slow.

The acute angle of the swing trajectory means that the head is entered from relatively upwards immediately before the impact, namely, like an upright swing. The obtuse angle means that the head is entered relatively along the ground, namely, like a flat swing (swinger type).

Figure 2:
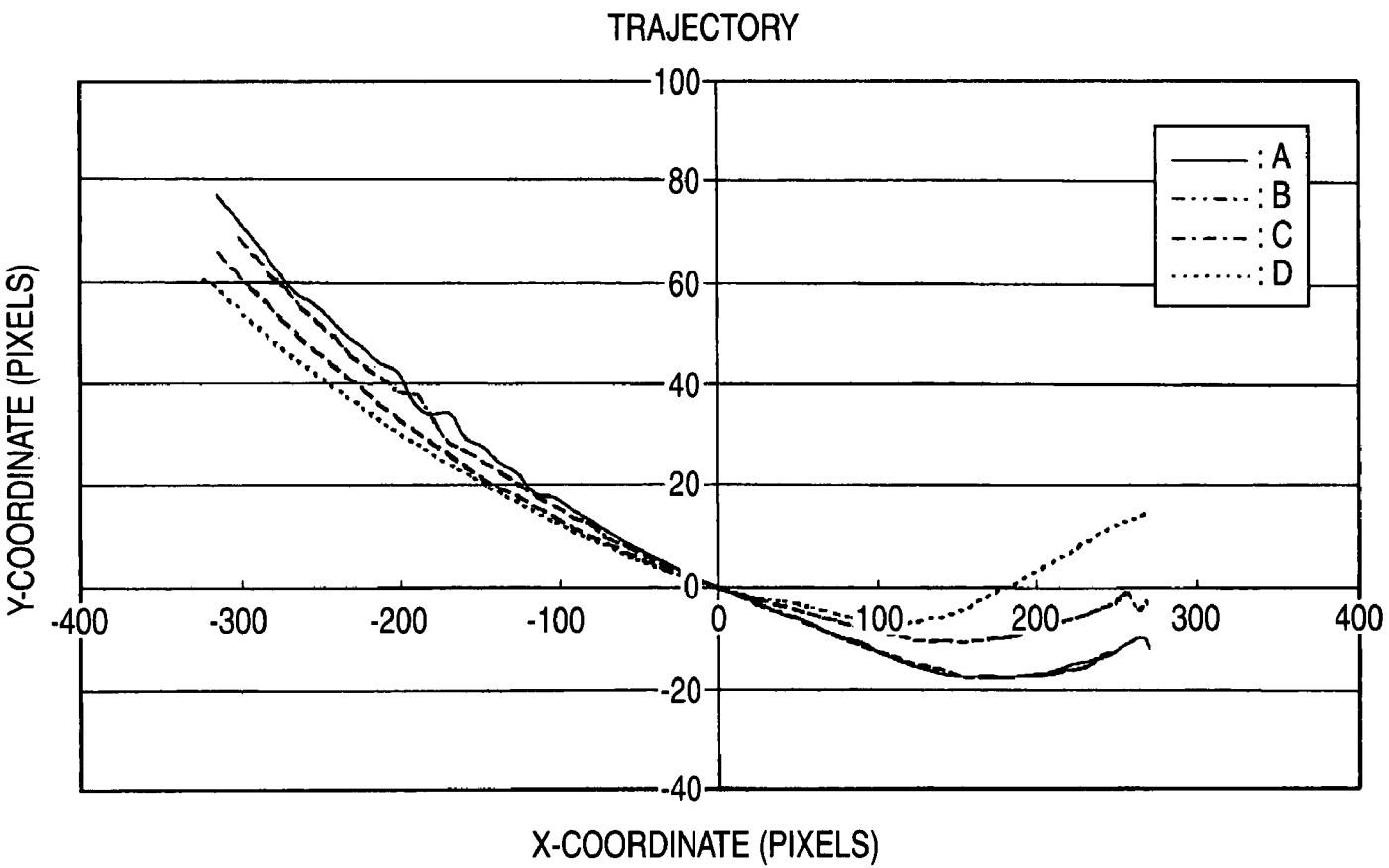
FIG. 2 is a trajectory diagram of the head by subjects.
Figure 3:
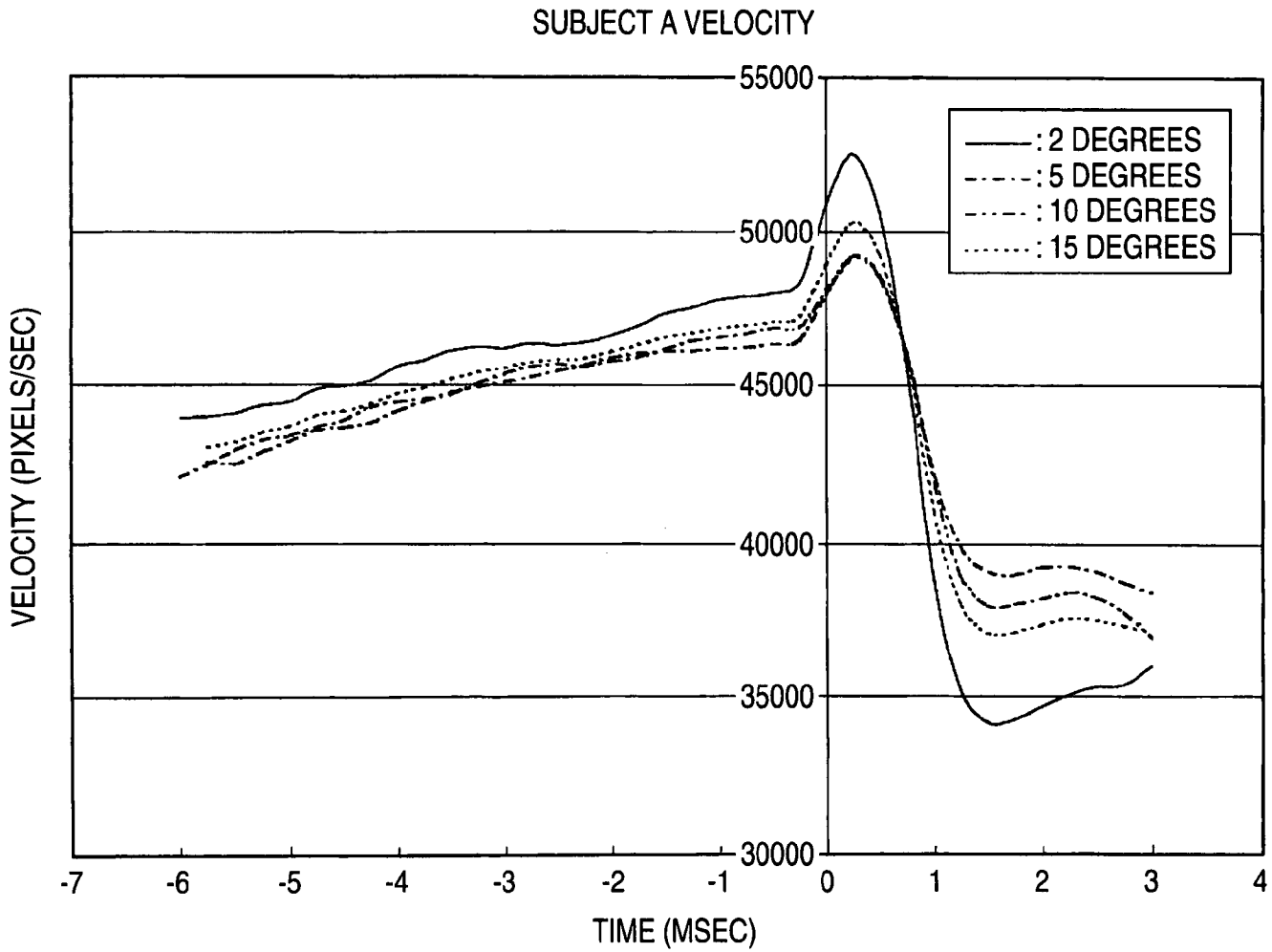
FIG. 3 is a diagram of the head speed by the subjects.
Figure 4:
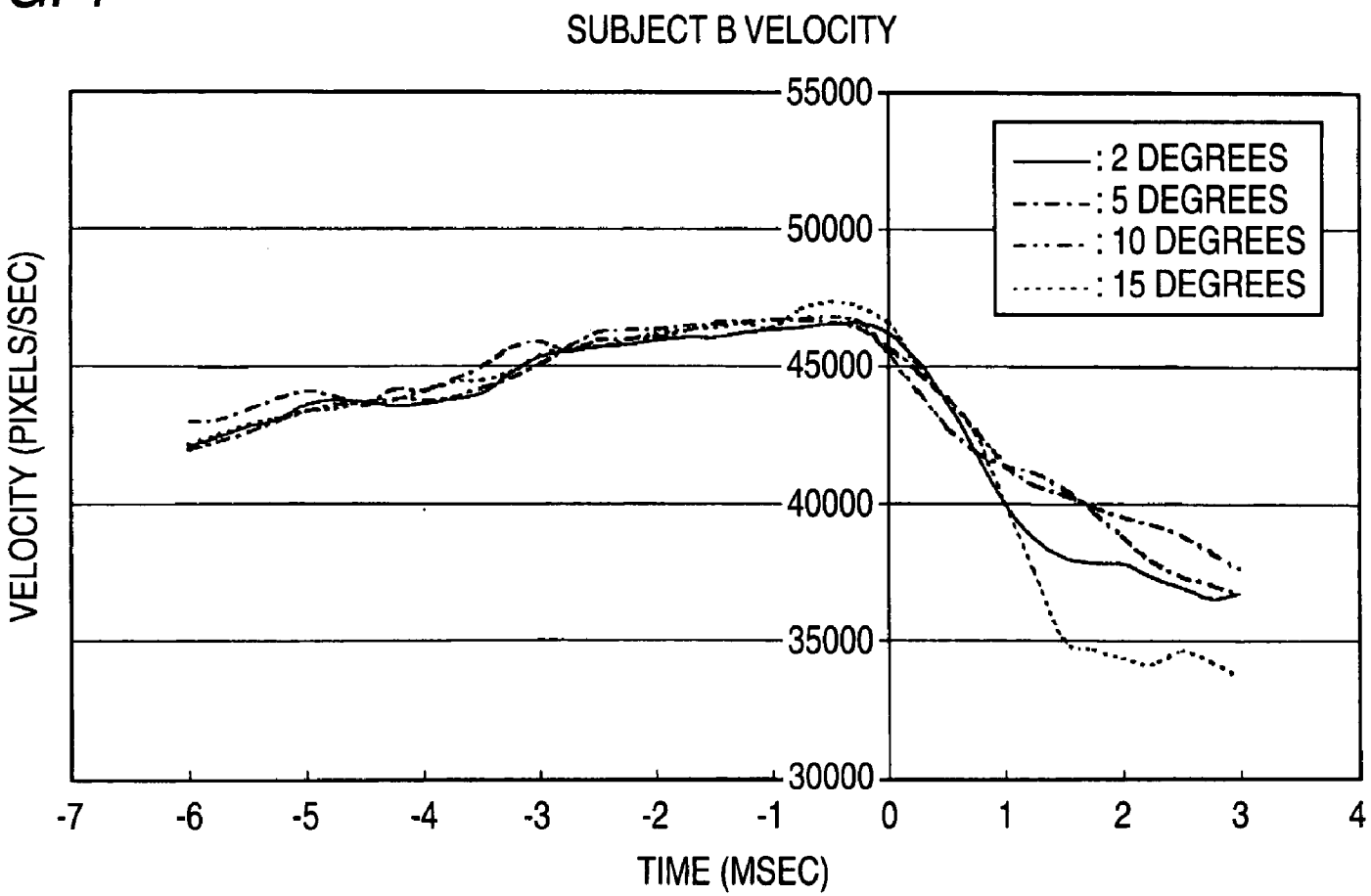
FIG. 4 is a diagram of the head speed by the subjects.
Figure 5:
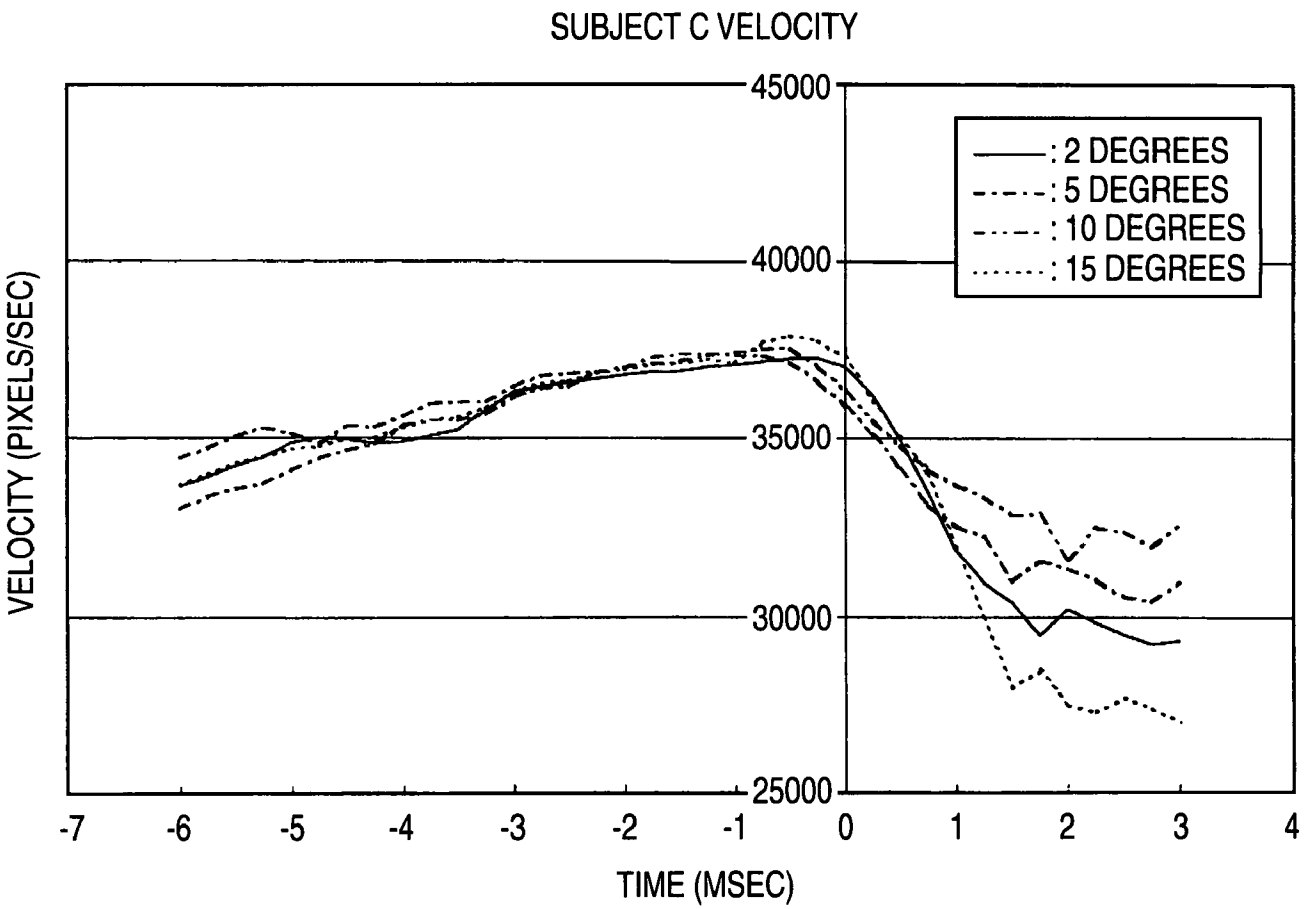
FIG. 5 is a diagram of the head speed by the subjects.
Figure 6:
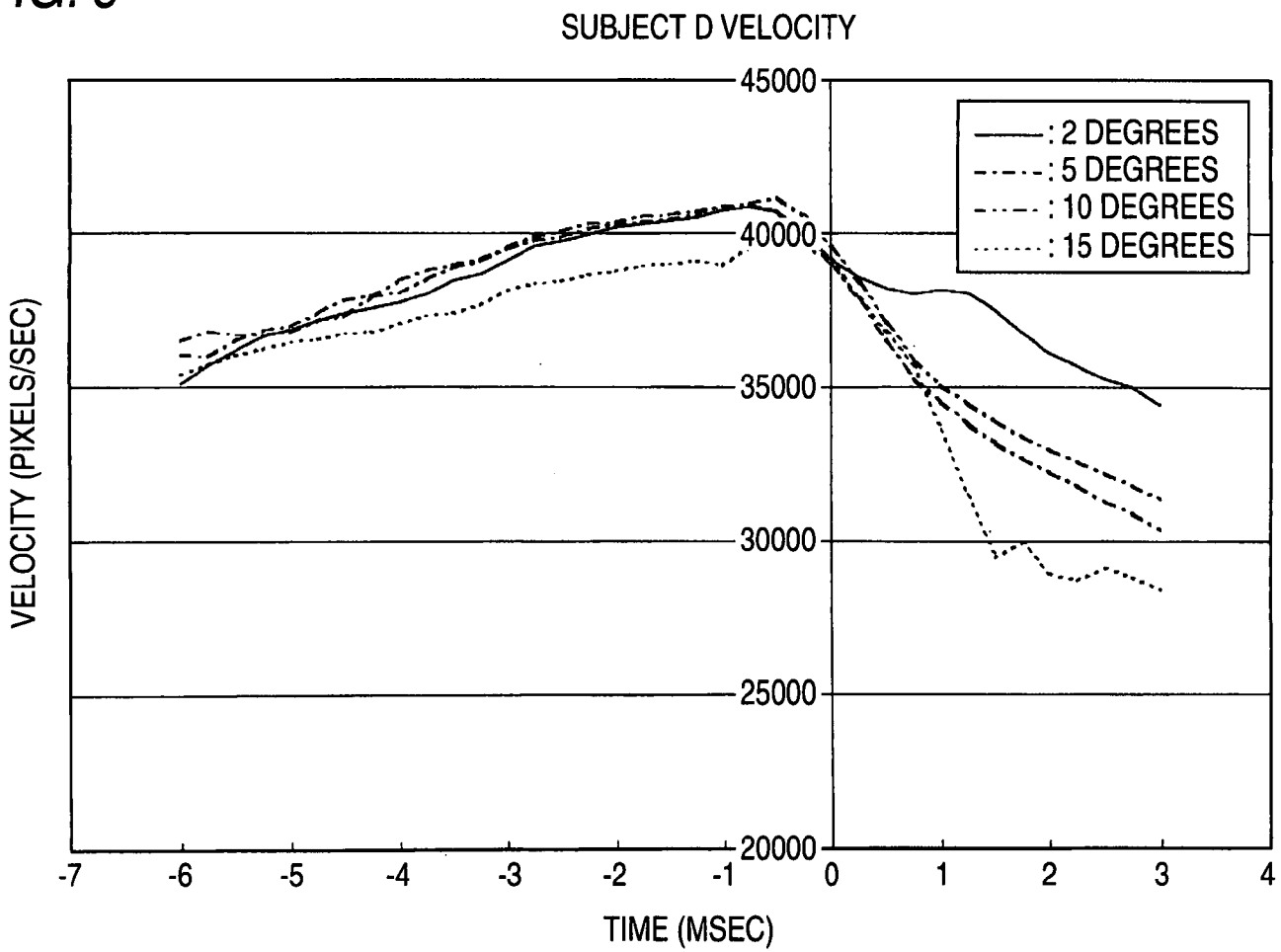
FIG. 6 is a diagram of the head speed by the subjects.

FIG. 2 shows the X-Y coordinates of a swing trajectory for the subject. FIGS. 3 to 6 show the head speed of each subject for every club with different bounce angle.

The four subjects swing each club on the fairway lawn in the golf course, and the results of evaluating the swing sense at four stages are shown in Table 2.

Minus of $\theta_2$ in comparative example 8 indicates that the sole is convex.

TABLE 2

| | No. | $L_1$ (mm) | $\theta_1$ (°) | $L_2$ (mm) | $\theta_2$ (°) | Subject A | B | C | D |
|---|---|---|---|---|---|---|---|---|---|
| Example 1 | 3 | 5 | 8 | 10 | 4 | ○ | ○ | ○ | ○ |
| | 6 | 7 | 9 | 10 | 5 | ○ | ○ | ○ | ○ |
| | 9 | 10 | 10 | 10 | 6 | ○ | ○ | ○ | ○ |
| Example 2 | 3 | 7 | 5 | 8 | 2 | ○○ | ○ | ○○ | ○ |
| | 6 | 8 | 7 | 9 | 3 | ○ | ○ | ○ | ○ |
| | 9 | 10 | 9 | 10 | 5 | ○ | ○ | ○ | ○○ |
| Comparative Example 1 | 3 | 15 | 2 | 0 | — | x | Δ | x | ○ |
| | 6 | 17 | 2 | 0 | — | x | Δ | x | ○ |
| | 9 | 20 | 2 | 0 | — | x | ○ | Δ | ○ |
| Comparative Example 2 | 3 | 15 | 5 | 0 | — | ○○ | ○ | ○ | x |
| | 6 | 17 | 5 | 0 | — | ○ | ○ | Δ | x |
| | 9 | 20 | 5 | 0 | — | ○ | ○ | x | ○ |
| Comparative Example 3 | 3 | 15 | 10 | 0 | — | ○ | x | x | x |
| | 6 | 17 | 10 | 0 | — | ○ | Δ | Δ | x |
| | 9 | 20 | 10 | 0 | — | ○ | Δ | ○ | Δ |
| Comparative Example 4 | 3 | 15 | 15 | 0 | — | x | x | x | x |
| | 6 | 17 | 15 | 0 | — | Δ | x | x | x |
| | 9 | 20 | 15 | 0 | — | ○ | Δ | Δ | x |
| Comparative Example 5 | 3 | 15 | 5 | 0 | — | ○○ | ○ | ○○ | x |
| | 6 | 17 | 7 | 0 | — | ○ | ○ | ○ | x |
| | 9 | 20 | 9 | 0 | — | ○ | Δ | ○ | Δ |
| Comparative Example 6 | 3 | 15 | 2 | 0 | — | x | Δ | x | ○ |
| | 6 | 17 | 3 | 0 | — | Δ | ○ | Δ | ○ |
| | 9 | 20 | 5 | 0 | — | ○ | ○ | ○ | ○ |
| Comparative Example 7 | 3 | 5 | 4 | 10 | 8 | ○ | x | x | x |
| | 6 | 7 | 5 | 10 | 9 | ○ | Δ | Δ | x |
| | 9 | 10 | 6 | 10 | 10 | ○ | Δ | ○ | Δ |
| Comparative Example 8 | 3 | 5 | 4 | 10 | −4 | ○○ | ○ | ○ | x |
| | 6 | 7 | 5 | 10 | −5 | ○ | ○ | Δ | x |
| | 9 | 10 | 6 | 10 | −6 | ○ | ○ | x | Δ |

○○: Very good;
○: Good;
Δ: Neither good nor bad;
x: Bad

As shown in Table 2, every subject has a good swing sense in the examples of the invention. That is, an iron golf club head that changes the bounce angle at two stages is more adaptable to every person of any swing type and head speed.

What is claimed is:

1. An iron set comprising:

a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole is smaller than a bounce angle $\theta_1$ of the front sole, and a width $L_2$ of the rear sole in a front-rear direction is greater than or equal to a width $L_1$ of the front sole in the front-rear direction, the width $L_1$ is from 5 to 12 mm in any of the golf clubs, the bounce angle of the front sole for the number n club is greater than or equal to the bounce angle of the front sole for the number (n-1) club and greater than the bounce angle of the front sole for the number (n-2) club, and wherein the bounce angle of the front sole for the number six iron is from 6° to 9°, and the bounce angle of the rear sole is from 2° to 5°.

2. The iron set according to claim 1, wherein the bounce angle of the front sole is 2° to 7° greater than the bounce angle of rear sole.

3. An iron set comprising:

a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole is smaller than a bounce angle $\theta_1$ of the front sole, and a width $L_2$ of the rear sole in a front-rear direction is greater than or equal to a width $L_1$ of the front sole in the front-rear direction, the width $L_1$ is from 5 to 12 mm in any of the golf clubs, the bounce angle of the front sole for the number n club is greater than or equal to the bounce angle of the front sole for the number (n-1) club and greater than the bounce angle of the front sole for the number (n-2) club, and wherein the bounce angle of the front sole for the number nine iron is from 8° to 10°, and the bounce angle of the rear sole is from 4° to 7°.

4. The iron set according to claim 3, wherein the bounce angle of the front sole is 2° to 7° greater than the bounce angle of rear sole.

5. An iron set comprising:

a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole is smaller than a bounce angle $\theta_1$ of the front sole, and a width $L_2$ of the rear sole in a front-rear direction is greater than or equal to a width $L_1$ of the front sole in the front-rear direction, the width $L_1$ is from 5 to 12 mm in any of the golf clubs, and the bounce angle of the front sole for the number n club is greater than or equal to the bounce angle of the front sole for the number (n-1) club and greater than the bounce angle of the front sole for the number (n-2) club;

wherein the bounce angle of the rear sole for the number n club is greater than or equal to the bounce angle of the rear sole for the number (n-1) club and greater than the bounce angle of the rear sole for the number (n-2) club; and wherein the bounce angle of the front sole for the number six iron is from 6° to 9°, and the bounce angle of the rear sole is from 2° to 5°.

6. The iron set according to claim 5, wherein the bounce angle of the front sole is 2° to 7° greater than the bounce angle of rear sole.

7. An iron set comprising:

a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole is smaller than a bounce angle $\theta_1$ of the front sole, and a width $L_2$ of the rear sole in a front-rear direction is greater than or equal to a width $L_1$ of the front sole in the front-rear direction, the width $L_1$ is from 5 to 12 mm in any of the golf clubs, and the bounce angle of the front sole for the number n club is greater than or equal to the bounce angle of the front sole for the number (n-1) club and greater than the bounce angle of the front sole for the number (n-2) club;

wherein the bounce angle of the rear sole for the number n club is greater than or equal to the bounce angle of the rear sole for the number (n-1) club and greater than the bounce angle of the rear sole for the number (n-2) club; and wherein the bounce angle of the front sole is 2° to 7° greater than the bounce angle of rear sole.

8. An iron set comprising:

a plurality of iron golf clubs, in which loft angles of heads are larger as the number is increased, each golf club including the head having a sole that includes a front sole on a front side and a rear sole adjacent to the front sole, wherein a bounce angle $\theta_2$ of the rear sole is smaller than a bounce angle $\theta_2$ of the front sole, and a width $L_2$ of the rear sole in a front-rear direction is greater than or equal to a width $L_1$ of the front sole in the front-rear direction, the width $L_1$ is from 5 to 12 mm in any of the golf clubs, and the bounce angle of the front sole for the number n club is greater than or equal to the bounce angle of the front sole for the number (n-1) club and greater than the bounce angle of the front sole for the number (n-2) club;

wherein the bounce angle of the rear sole for the number n club is greater than or equal to the bounce angle of the rear sole for the number (n-1) club and greater than the bounce angle of the rear sole for the number (n-2) club; and wherein the bounce angle of the front sole for the number nine iron is from 8° to 10°, and the bounce angle of the rear sole is from 4° to 7°.

9. The iron set according to claim 8, wherein the bounce angle of the front sole is ° to 7° greater than the bounce angle of rear sole.

* * * * *